United States Patent [19]

Brown

[11] Patent Number: 4,617,993

[45] Date of Patent: Oct. 21, 1986

[54] CARBON DIOXIDE STIMULATED OIL RECOVERY PROCESS

[75] Inventor: Alfred Brown, Houston, Tex.

[73] Assignee: Texaco Inc., White Plains, N.Y.

[21] Appl. No.: 772,108

[22] Filed: Sep. 3, 1985

[51] Int. Cl.[4] ..... E21B 43/00

[52] U.S. Cl. ..... 166/250; 166/279; 166/305.1

[58] Field of Search ..... 166/250, 263, 279, 300, 166/305.1

[56] References Cited

U.S. PATENT DOCUMENTS

| | | | |
|---|---|---|---|
| 3,333,637 | 8/1967 | Prats | 166/285 |
| 3,841,406 | 10/1974 | Burnett | 166/305.1 |
| 3,871,451 | 3/1975 | Brown | 166/305.1 |
| 3,954,141 | 5/1976 | Allen et al. | 166/305.1 |

*Primary Examiner*—Stephen J. Novosad
*Assistant Examiner*—William P. Neuder
*Attorney, Agent, or Firm*—Jack H. Park; Kenneth R. Priem

[57] ABSTRACT

A method for recovering petroleum from a subterranean petroleum formation penetrated by at least one well in fluid communication with the formation, by a cyclic carbon dioxide injection procedure comprising injecting carbon dioxide into the well followed by a soak period, followed by a production of oil from the formation, wherein the improvement comprises introducing a predetermined quantity of hydrocarbon such as high API gravity crude oil, naphtha, kerosene, gasoline or aromatic solvent which will remain liquid at the temperature of the formation into the formation immediately after introducing the carbon dioxide slug and before the soak and production steps, to dissolve high molecular weight fraction of the crude oil left in the flow channels of the formation, which are recovered from the formation in the production phase. The volume of solvent use is sufficient to fill the well and saturate the formation for a distance of from 4 to 10 feet into the formation.

11 Claims, No Drawings

CARBON DIOXIDE STIMULATED OIL RECOVERY PROCESS

FIELD OF THE INVENTION

The present invention is concerned with a process of stimulating the production of oil or petroleum from a subterranean reservoir. More particularly, this invention is concerned with an improvement in a process for stimulating oil recovery in which carbon dioxide is injected into a petroleum-containing reservoir and thereafter petroleum is recovered from the reservoir via the same well as was used for carbon dioxide injection.

BACKGROUND OF THE INVENTION

It is well known to persons skilled in the art of oil recovery that the amount and rate of oil production from many reservoirs can be increased by introducing carbon dioxide into the reservoir. Carbon dioxide is readily absorbed by the formation petroleum, which results in two benefits; namely, the oil volume is increased as carbon dioxide is absorbed, and the viscosity of the oil or petroleum is decreased. Both of these phenomenon lead to increased oil recovery. Enhanced oil recovery methods employing carbon dioxide injection have been used successfully in many fields, and generally the oil recovery methods employing carbon dioxide may be categorized as either a carbon dioxide drive process or a push-pull carbon dioxide stimulation process. In the drive process, a quantity of carbon dioxide is injected into a reservoir and then displaced by a less expensive drive fluid such as water or natural gas, which accomplishes displacement of petroleum through the formation to another, remotely located production well from which it is recovered to the surface of the earth. In the second type of enhanced oil recovery process, carbon dioxide is injected into a reservoir by a well in fluid communication therewith, and allowed to soak for a predetermined period of time, after which the oil having carbon dioxide dissolved therein, is back flowed into the same well as was utilized for carbon dioxide injection and thereby recovered to the surface of the earth. This latter technique is sometimes referred to as push-pull or huff-and-puff carbon dioxide flooding. While the first method described, the multi-well carbon dioxide flooding drive procedure recovers relatively large quantities of petroleum, the improved recovery usually requires that miscibility be obtained in the reservoir, which requires high injection pressures and frequently necessitates the addition of hydrocarbon solvents to achieve a true miscible displacement condition. Also, a significant quantity of carbon dioxide is injected and long time periods are required between injection of carbon dioxide before the increased oil recovery is obtained. By contrast, carbon dioxide stimulation by the push-pull method requires much less carbon dioxide and the stimulated increase in oil production is achieved in a much shorter time frame, in the order of weeks rather than years. Of course, a large field may be exploited by the push-pull carbon dioxide stimulation technique by simultaneous or sequential use of plurality of wells, each being utilized as an injection well in the first step of the stimulation process and as a production well in the second step. The term "single well" push-pull carbon dioxide stimulation as is sometimes applied to this process only means that the same well is used for both injection and production, and the process can be applied with only a single well.

While the carbon dioxide push-pull stimulation technique is frequently commercially successful, the results in some fields are sometimes less successful than had been predicted, because the production flow rate of petroleum from the formation into the well after injection of carbon dioxide and soak is much lower than it was expected. The reason for the less-than-expected production flow rate has never been satisfactorily explained, and no subsequent treatment is known which will improve the flow rate. Accordingly, despite the fact that push-pull carbon dioxide stimulation has been effective in some applications, there is still a significant unfulfilled commercial need for a method which will permit achievement of the anticipated benefit from push-pull carbon dioxide stimulation process with improved production rates from the wells used in the process.

PRIOR ART

The following briefly summarizes the known prior art which relates to the subject process.

U.S. Pat. No. 4,390,068, J. T. Patton and C. N. Canfield, June 28, 1983 describes a push-pull carbon dioxide stimulation process in which liquid phase carbon dioxide is injected into the formation, allowed to soak for a predetermined period of time, and them production is initiated from the same well while maintaining a specified back-pressure.

U.S. Pat. No. 3,330,342, L. W. Holm, Jul. 11, 1967, describes a well to well carbon dioxide displacement process utilizing a mixture of carbon dioxide and a low molecular weight hydrocarbon, or a slug of hydrocarbon injected prior to the injection of carbon dioxide gas.

U.S. Pat. No. 3,954,141, J. C. Allen, C. D. Woodward, A. Brown, and C. H. Wu, May 4, 1976, describes an oil recovery process which may be a single well push-pull or multi-well displacement process, employing a mixture of a normally liquid hydrocarbon and a normally gaseous solvent which may be hydrocarbon or carbon dioxide.

U.S. Pat. No. 3,811,503 describes an enhanced oil recovery method of the multi-well displacement type employing a mixture of carbon dioxide and light hydrocarbons in a critical ratio which forms a miscible transition zone between the mixture and the reservoir oil.

U.S. Pat. No. 4,136,738, S. Haynes, Jr. and F. H. Lim and R. B. Alston, Jan. 30, 1979, describes a multi-well displacement type of enhanced oil recovery method employing injecting first a slug of light hydrocarbon at a high rate followed by injecting carbon dioxide at a low rate to promote mixing between the hydrocarbon and carbon dioxide.

SUMMARY OF THE INVENTION

I have discovered that the problem associated with low productivity after injection of a slug of carbon dioxide is caused by a deposition of the high molecular weight fraction of formation crude oil which has been left in the flow channels of the formation adjacent the production well after the lower molecular weight fraction of the crude oil has been fractionated or selectively removed from the whole crude oil originally occupying the space adjacent to the production well, by the injected carbon dioxide fluid. Continued movement of fluid into the formation during the carbon dioxide injection phase, and subsequent movement of the mixture of formation petroleum and carbon dioxide in the early portion of the fluid production phase of the cyclic carbon dioxide flooding process results in formation of a zone adjacent to the production well having relatively high concentrations of these high molecular weight fraction formation petroleum. Loss of permeability in the portion of the formation immediately adjacent to the production well can be decreased or avoided altogether if after injection of the slug of carbon dioxide into the formation, that slug is followed immediately by the injection of a quantity of liquid hydrocarbon which remains liquid at the formation temperature and the injection pressure, sufficient to invade the portion of the permeable formation for a distance of from 4 to 10 feet from the injection well, plus sufficient volume to completely fill the injection string of the well. This allows contact between a relatively large quantity of liquid hydrocarbon with the high molecular weight hydrocarbon fraction of formation petroleum responsible for loss of permeability, thereby permitting removal of the permeability-reducing materials in the early part of the production cycle.

DESCRIPTION OF THE PREFERRED EMBODIMENTS

The process of the present invention involves a method for stimulating production of petroleum from a subterranean deposit thereof by cyclic carbon dioxide injection, which is commonly referred to as push-pull or huff and puff $CO_2$ stimulation. This process can be applied to a reservoir with as little as a single well drilled into the reservoir. Carbon dioxide is introduced into the formation via the well by injection under pressure, generally as high as is consistent with the supply of carbon dioxide and the tolerance of the formation to injection pressure. It is commonly estimated that the injection pressure should be in the range of from about 0.5 to about 0.8 pounds per square inch per foot of formation depth, although this can vary from one application to another depending on the particular formation being stimulated. The carbon dioxide is frequently made available in a high pressure form which insures that it is in the liquid state, although it is not essential to the present process whether the physical state of the carbon dioxide is liquid, gaseous or a mixture thereof at the time it enters the petroleum formation. Stimulation of this type usually contemplates that a plurality of cycles will be applied to the formation, each cycle comprising an injection phase in which carbon dioxide is introduced into the formation at a predetermined pressure until the flow rate diminishes, indicating that it has contacted about as much of the formation as is possible in the first cycle, after which injection is terminated and generally prior art references teach that a back pressure should be held on the fluid and the fluid allowed to soak in the formation for a predetermined period of time. After this soak period is completed, production of fluid from the formation via the well is begun, usually with a back pressure being held on the well during the production phase in order to ensure maximum petroleum production rather than a rapid withdrawal of the previously injected gas. As a general rule, where several stimulation cycles are used, the quantity of carbon dioxide injected in the second cycle will be somewhat larger than the quantity injected in the first injection cycle for several reasons. The first cycle will result in removal of petroleum from the formation, thereby increasing the porosity and permitting injection of larger quantities of carbon dioxide into the portion of the formation immediately adjacent to the production well than was originally feasible. The oil removal in the first cycle also permits the carbon dioxide to expand further into the formation in the second cycle, thereby contacting reservoir petroleum not contacted during the first injection cycle. The amount of carbon dioxide introduced into the formation depends of course on the thickness of the petroleum containing formation being stimulated and also on the porosity of the formation, since only the formation void space will be available to accept injected fluids. Prior art references teach that the amount of carbon dioxide that can be utilized in this type of stimulation is from 0.5 ton to approximately 20 tons per foot of formation depth. In the process of my invention, it is contemplated that the first injection phase will involve the use of from 0.4 to 16.0 and preferably 0.5 to 14.0 tons of carbon dioxide per foot of formation depth, with each successive cycle utilizing from 1 to 25 and preferably 5 to 20 percent more carbon dioxide than was used in the preceding cycle.

The process of my invention is specifically aimed at curing the problem which occurs when carbon dioxide passes through a formation containing petroleum which is comprised of a wide range of molecular species of varying molecular weight. For example, in a particular field being considered for carbon dioxide stimulation, the formation petroleum was a relatively light 22° API gravity. This API gravity represents the average API gravity of the fluid, even though there are components of the crude oil which would have higher API gravity (lower molecular weight) and there are components having lower API gravity (higher molecular weight) than the average figure for the crude. It was discovered that the passage of carbon dioxide through a portion of formation containing this 22° API gravity oil resulted in fractionation of the crude oil, with the higher API gravity crude being stripped from the crude oil and displaced by the carbon dioxide and leaving behind a relatively immobile 13° API gravity oil. In applying a conventional cyclic carbon dioxide stimulation to this process, the result is that the higher API gravity components on the 22° API gravity crude were displaced by the carbon dioxide, leaving a deposit of 13° API gravity crude in the flow channels of the formation. Injection of carbon dioxide was followed by a soak period which was then followed by a reversal of flow which caused fluids to flow from the formation toward the producing well. The passage of the lighter weight or higher API gravity components of the crude oil first began displacing the more viscous components until they had been moved and thereby concentrated in a zone sufficient to block some of the smaller flow channels in the formation, thus drastically reducing the flow rate of fluids from the formation into the production well. The concentration of high API gravity components was insufficient to dissolve the low API gravity components. It was observed in this particular field that oil production from the field decreased from an early initial rate of 20 to 25 barrels per day to only about 10 barrels per day because of this above described phenomenon. Water production from the well also decreased, indicating that the blockage had occurred in the water flow channels as well as in the oil flow channels. Ordinarily, one skilled in the art of oil recovery would expect that the oil production rate would be increasing from the initial value as the mixture of carbon dioxide, solvent stripped from the crude and crude moved closer to the well.

The process of my invention, aimed at alleviating the above described problem, involves several changes over the procedure described in the prior art. Carbon dioxide injection into the formation via the well is accomplished essentially as has been described in prior art references. At the end of the carbon dioxide injection phase, a quantity of hydrocarbon is injected immediately after the carbon dioxide in a quantity sufficient to fill the injection well and to occupy the available pore spaces in the formation for a distance of from four to ten feet into the formation. This represents a relatively small quantity of hydrocarbon. The presence of a liquid filled hydrocarbon injection well accomplishes several advantages. Back flow of carbon dioxide from the portion of the formation immediately adjacent to the well is prevented because of the hydrostatic head of the liquid hydrocarbon present in the injection well. The presence of the high concentration of liquid hydrocarbon in the portion of the formation immediately adjacent to the injection well permits dissolution of any low API gravity (high molecular weight) fractions of the formation crude oil left in the flow channels of the formation as the carbon dioxide passed therethrough in the first injection phase, and permits dissolution of these materials in the injected liquid hydrocarbon during the soak phase. The liquid hydrocarbon also prevents corrosion of the tubular goods and other metal components of the well.

It is essential that the contact between solvent and the immobile hydrocarbon occur in the sequence disclosed. Injection of solvent in advance of carbon dioxide injection will not prevent the problem from occurring because the solvent mixes with the whole crude oil and is dissipated. Comingling small amounts of solvent with $CO_2$ is less effective and require much larger volumes of solvent. By allowing the separation by $CO_2$ to occur first, the solvent only contacts the separated low API gravity crude and so a small amount of solvent is effective for dissolving the immobile hydrocarbon from the critical near wellbore region.

The hydrocarbon solvent utilized for the process of my invention may be any hydrocarbon which remains liquid at the formation temperature. A light (high API gravity) crude oil, e.g., any available crude oil whose API gravity is in excess of 24 and preferably over 33° API can be utilized in the process of my invention. Naphtha, kerosene, diesel oil, natural gasoline, and other liquid hydrocarbons can also be utilized. Aromatic solvents which are mixed higher molecular weight aromatic hydrocarbons are frequently available commercially, and these are suitable for use in the process of my invention, and are especially desirable when the crude oil present in the formation is known or determined to be a crude oil having a high asphaltene content. Specifically, if the asphaltene content of the crude oil is in excess of 5%, the solvent utilized in the process of this invention should be one relatively high in aromatic hydrocarbons. Essentially pure benzene, toluene or xylene may also be utilized, provided the temperature of the formation is efficiently low that this material will be all in the liquid phase at injection conditions.

Ideally, a sample of formation matrix and fluid should be obtained, and tested under laboratory conditions to determine the nature of immobile hydrocarbons remaining in the flow channels of the formation after passage of carbon dioxide therethrough. By using this preferred embodiment, one can determine precisely the best solvent for use in the process of my invention.

I have also discovered that when the small solvent slug is introduced into the formation immediately after injection of the carbon dioxide, there is a preferred method for operating the soak cycle over that described in the prior art references. Rather than maintaining the previous injection pressure or closing in the well for a predetermined period of time, the well is left essentially in a stable condition with the hydrostatic pressure of the chaser solvent slug in the well being the only backpressure retained on the formation. The pressure is then determined in the injection well at a point adjacent to the formation. The injection pressure will decline as the carbon dioxide is absorbed into the formation petroleum. It will never decline all the way to the original formation pressure prior to carbon dioxide injection, however. I have found that the soak cycle should be maintained only until the pressure in the well adjacent to the formation declines to a level which usually may be defined as from 25 to 95 and preferably from 40 to 90% of the original injection pressure, which will ordinarily still be from 5 to 80% greater than the formation pressure prior to carbon dioxide injection. The formation pressure at which the soak cycle should be terminated may also be defined as from 100–500 psi above the original formation pressure. Occasionally, a formation is encountered where the pressure does not decline to the above defined level. In this case, the soak period is terminated when the pressure decline rate falls to a value of about 2 to 15% per 24-hour period. In no event should the soak period extend beyond about 10–12 days. This accomplishes the desired absorption of carbon dioxide into the formation petroleum, which causes swelling of the oil and reduction in the crude oil viscosity, without running the risk of excessive loss of the injected carbon dioxide, and while still maintaining sufficient pressure in the portion of the formation adjacent to the production well to support the flow of fluids into the well during the next cycle.

The next phase of this cycle involves producing fluids from the formation. It is to be expected that the flow rate will be high at the beginning of the production phase, with an increase occurring as the stripped high API gravity component approaches the well bore, but a pressure decline will develop somewhat later as pressure is depleted and the portion of the crude oil whose viscosity is reduced by carbon dioxide absorption is recovered from the formation. Ordinarily, the production phase will be continued so long as the flow rate of crude oil being produced from the formation does not drop below the flow rate prior to stimulation, or to the economic limit, whichever is greater.

Since the effect of production rate reduction caused by the high molecular weight components of the formation crude oil is most detrimental when it occurs in the portion of the formation immediately adjacent to the production well, it is not always necessary that the solvent injection cycle be continued during all of these future cycles of carbon dioxide injection and fluid production. In some formations it is adequate if the solvent chaser slug is used only after the first carbon dioxide injection phase. Certainly no more than a second solvent injection should be necessary in many formations in order to ensure that future cycles of carbon dioxide injection and followed by soak and fluid production will not be impeded by the presence of low API gravity components of the crude oil blocking the flow channels of the formation, decreasing the flow rate of fluids from the formation into the production well.

The following field example is offered as a specific example of a best mode for applying the process of my invention. This example is given for the purpose of ensuring complete disclosure, and it is not intended to be in any way limitative or restrictive of the process of my invention.

FIELD EXAMPLE

An oil reservoir is located at a depth of 4,000 feet and the thickness of the formation at the point where it is penetrated by a well is 37 feet. The reservoir porosity is 0.30 (30%) and the permeability is 400 MD. The reservoir contains 22° API gravity crude oil, and it is desired to stimulate production of the crude oil from this reservoir by means of cyclic carbon dioxide injection production utilizing a single well. The formation pressure is 700 psi. Previous attempts to stimulate oil production from this reservoir have been unsatisfactory because the flow rate of fluids from the formation declined very rapidly to a level too low to permit continued production on an economic basis. Core samples obtained from the well where the unsuccessful stimulation attempt occurred indicated that the flow channels immediately adjacent to this well were plugged with low API gravity oil which was essentially immobile at formation conditions.

In applying the improved process according to my invention, carbon dioxide is injected into the well from a commercial supply at a pressure of 2,000 psi, which permitted an average injection rate of approximately 6.4 BPM (barrels per minute) average over the period of time required to inject the desired quantity of carbon dioxide. Since this well had not been previously stimulated by carbon dioxide injection, 418 tons of carbon dioxide were required in the first injection cycle.

It was decided that the slug of carbon dioxide would be followed immediately by the injection of a high API gravity crude oil being produced from another formation relatively close to the well being stimulated. It was desired to inject sufficient high API gravity crude to permit saturation of a cylindrically shaped cylinder in the formation roughly ten feet in diameter, which ensured that the portion of the formation for approximately five feet in all directions from the well bore would be saturated with the injected high API gravity crude. The quantity of crude oil required to saturate the formation is calculated below:

$$\text{vol.} = 11\ (\text{radius})^2\ (\text{formation thickness})\ (\text{porosity})$$

In this example, the volume of solvent to saturate the formation for five feet from the injection well is:

$$(5)^2\ (37\ \text{feet} \times 0.30) = 873\ \text{cubic feet}$$

It can be seen from the above that the quantity of high API gravity crude required in this instance is simply a function of the thickness of the formation, the diameter of the zone in which treatment is desired, and the porosity of the formation immediately adjacent to the well. In addition, approximately 87.3 cubic feet of crude are required to completely fill the injection well to a point approximately at the surface of the earth. Accordingly, a total of 960.3 cubic feet or 171 barrels of high API gravity crude are injected for this purpose.

The pressure in the injection well adjacent the formation is monitored after the carbon dioxide and high API gravity crude have been injected, and it is determined that the pressure declines from approximately 2,150 psi immediately after $CO_2$ injection to approximately 1,075 psi over a period of 12 days, which satisfies my requirement that the pressure be allowed to decline to a value of approximately 50% below the initial injection pressure. It should be noted that the soak period does not extend until the pressure has returned to a value equal to the original formation pressure, which was about 700 psi in this instance.

After completion of the above injection phase and soak period, the well is placed on production. It is observed that oil production occurs at a rate of approximately 60 barrels per day and after 100 days the production rate is still approximately 20 barrels per day, which is a very satisfactory performance. In this instance, a second cycle involving carbon dioxide injection and high API gravity crude oil injection is applied to this well to ensure that no blockage occurs during the ensuing production cycles. Approximately the same procedure as was described earlier, is utilized, except the quantity of carbon dioxide employed is 481 tons and the quantity of high API gravity crude oil introduced into the well in the second cycle is 75 barrels, sufficient to fill the tubing and provide sufficient back pressure to prevent $CO_2$ blowing back at a high rate.

After completion of the above two cycles of injecting carbon dioxide and the high API gravity crude, subsequent stimulation cycles only require the introduction of carbon dioxide followed by a soak period until the pressure has declined according to the limits given above, followed by production of oil from the formation. In this instance, 2 additional cycles of carbon dioxide injection and oil production are applied to the formation before it is determined that the quantity of carbon dioxide required to achieve additional stimulation is excessive for the amount of additional oil production that could be recovered.

While my invention has been described in terms of a number of illustrative embodiments, it is clearly not so limited since many variations thereof will be apparent to persons skilled in the art of stimulated oil production without departing from the true spirit and scope of my invention. It is my intention and desire that my invention be limited only by those limitations and restrictions which appear in the claims appended immediately hereinafter below.

I claim:

1. A method for recovering petroleum from a subterranean petroleum-containing formation penetrated by at least one well in fluid communication with the formation, by a cyclic carbon dioxide injection procedure comprising injecting carbon dioxide into the well followed by a soak period, followed by a production phase wherein oil is recovered from the formation via the well, wherein the improvement comprises introducing a predetermined quantity of hydrocarbon which is liquid at the temperature of the formation into the formation immediately after introducing the carbon dioxide slug and before the soak and production steps, to dissolve high molecular weight fraction of the crude oil left in the flow channels of the formation, and recovering the solvent and high molecular weight fractions from the formation in the production phase via the well.

2. A method as recited in claim 1 wherein the liquid hydrocarbon is selected from the group consisting of crude oil having API gravity greater than 24°, kerosene, naphtha, natural gasoline, mixed aromatic solvents, and mixtures thereof.

3. A method as recited in claim 1 wherein the solvent introduced into the formation is sufficient to saturate a portion of the formation from 4 to 10 feet from the production well, and to fill the injection well to a point near the surface of the earth.

4. A method as recited in claim 1 wherein the liquid hydrocarbon is identified by obtaining a sample of formation matrix and fluids, passing carbon dioxide through the sample, and determining which liquid will dissolve the immobile hydrocarbon left in the flow channels of the formation after passage of carbon dioxide therethrough.

5. A method for recovering petroleum from a subterranean, petroleum-containing formation penetrated by at least one well comprising:

(a) introducing a predetermined quantity of carbon dioxide into the formation via the well;
(b) introducing a predetermined quantity of liquid hydrocarbon into the formation immediately after the $CO_2$;
(c) measuring the fluid pressure in the well adjacent to the formation;
(d) allowing the injected carbon dioxide and hydrocarbon to remain in the formation until the pressure has declined to a value which is from 10 to 50% of the original injection pressure;
(e) thereafter producing formation petroleum, together with the injected carbon dioxide and liquid hydrocarbon from the formation via the well.

6. A method as recited in claim 5 wherein the liquid hydrocarbon is selected from a group consisting of crude oil having API gravity greater than 30°, kerosene, naphtha, natural gasoline, mixed aromatic solvents, and mixtures thereof.

7. A method as recited in claim 5 wherein the quantity of carbon dioxide introduced into the formation is from 0.5 to 14 tons per foot of formation being treated.

8. A method as recited in claim 5 wherein the procedure is repeated at least once.

9. A method as recited in claim 5 wherein carbon dioxide is thereafter injected into the well followed by a soak period and production of carbon dioxide and petroleum from the formation.

10. A method as recited in claim 5 wherein the quantity of liquid hydrocarbon is sufficient to fill the well and saturate the formation adjacent to the well for a distance of from four to six feet from the well into the formation.

11. A method for recovering petroleum from a subterranean petroleum containing formation penetrated by at least one well comprising (a) introducing a predetermined quantity of carbon dioxide into the formation via the well;
(b) measuring the fluid pressure in the well adjacent to the formation;
(c) allowing the injected carbon dioxide to remain in the formation until the pressure has declined to a value which is from 10 to 50% of the original injection pressure;
(d) thereafter producing formation petroleum and the injected carbon dioxide from the formation vial the well.

* * * * *